US005141030A

United States Patent [19]

Arakawa

[11] Patent Number: 5,141,030

[45] Date of Patent: Aug. 25, 1992

[54] WARP MENDING DEVICE FOR FEEDING A MENDING YARN TO DROP WIRES AND A HEDDLE

[75] Inventor: Kazuyuki Arakawa, Kanazawa, Japan

[73] Assignee: Tsudakoma Corp., Ishikawa, Japan

[21] Appl. No.: 686,387

[22] Filed: Apr. 17, 1991

[30] Foreign Application Priority Data

Apr. 18, 1990 [JP] Japan ..... 2-100432
May 11, 1990 [JP] Japan ..... 2-119885

[51] Int. Cl.[5] ..... D03J 1/14
[52] U.S. Cl. ..... 139/35; 139/353
[58] Field of Search ..... 139/353, 35, 1 R, 358, 139/435.6; 28/211

[56] References Cited

U.S. PATENT DOCUMENTS 4,791,967 12/1988 Vandeweghe et al. ..... 139/358 X
4,817,675 4/1989 Dewaele et al. ..... 28/211
4,898,213 2/1990 Takegawa ..... 139/353 X
4,911,207 3/1990 Gryson et al. ..... 139/353
5,050,643 9/1991 Takegawa et al. ..... 139/35 X

FOREIGN PATENT DOCUMENTS

0158933A2 10/1985 European Pat. Off. .
0259915A1 3/1988 European Pat. Off. .
0295806A1 12/1988 European Pat. Off. .
0364404A2 4/1990 European Pat. Off. .
46-39150 11/1971 Japan .
63-28951 2/1988 Japan .
63-315648 12/1988 Japan .
1-174649 7/1989 Japan .
1-192853 8/1989 Japan .
2-210045 8/1990 Japan .

*Primary Examiner*—Andrew M. Falik
*Attorney, Agent, or Firm*—Wenderoth, Lind & Ponack

[57] ABSTRACT

A warp mending device draws a mending yarn unwound from a bobbin to a slot of a drop wire and a mail of a heddle corresponding to a trailing edge and a leading edge of a broken warp so that a loom is started. A positioning device is incorporated in the warp mending device for positioning drawing means relative to the mail of the heddle corresponding to the broken warp in a predetermined positional relationship therebetween when the warp is broken. The warp mending device includes: a yarn guide having a yarn guide line therein for guiding the mending yarn between the drop wire and the heddle corresponding to the broken warp; a nozzle for generating an air current inside the yarn guide line; a yarn leading device for drawing the mending yarn unwound from a bobbin into a slot of a drop wire or a mail of a heddle, whichever is located upstream of the drawing direction, and for leading the thus drawn mending yarn into an inlet of the yarn guide line. A positioning device is also provided for positioning the slot of the drop wire or the mail of the heddle, whichever is located downstream of the drawing direction relative to an outlet of the yarn guide line so as to confront the outlet.

5 Claims, 17 Drawing Sheets

WARP MENDING DEVICE FOR FEEDING A MENDING YARN TO DROP WIRES AND A HEDDLE

BACKGROUND OF THE INVENTION

1. Field of the Invention

The present invention relates to a warp mending device capable of feeding a mending yarn from a bobbin to drop wires and a heddle respectively positioned at the portion where one of the warps is broken in the weaving operation so that a loom can be restarted.

2. Prior Art

Japanese Laid-Open Patent Publication No. 1-192853 discloses a technique for mending a broken warp by connecting a broken warp at the side of the drop wires to the broken warp at the side of the heddles via a mending yarn when the warp is broken between the drop wires and the heddles. However, according to this technique there was a problem that the mending operation cannot be carried out when the warp is broken at the portion adjacent to the drop wires or heddles.

There is disclosed in Japanese Patent Laid-Open Publication No. 63-315648 discloses a technique that the yarn is drawn pneumatically between the drop wires and the heddles. However, this technique could not cope with the situation where the warp is broken during the weaving operation since the warp is automatically drawn into the drop wires and the heddles in a looming stage.

It is necessary to draw the mending yarn into a mail of the heddle corresponding to the broken warp at the time that the broken warp is mended. In the drawing operation, a heddle frame corresponding to the broken warp needs to be specified while it is necessary for the drawing means need be relatively positioned relative to the mail of the heddle supported by the heddle which is frame.

Such positioning of the drawing means relative to the mails of the heddles is conventionally effected by stopping the heddle frame at a predetermined shed position and operating the drawing means so that the drawing means and the mails of the heddles are correctly positioned relative to each other.

Inasmuch as the stopping position of the heddle frame produces an error and the stopping positions of a plurality of heddle frames are all different due to the shed size, thereby deteriorating the positioning precision. Furthermore, when the warp line or the shed size is varied, the moving range of the drawing means need to be varied, which complicates the operation. Still furthermore, when the warp line or the shed size is different for each loom, there is a likelihood that the vertical positioning is not effected precisely within a predetermined moving range so that the drawing means cannot be served or used for a plurality of looms.

SUMMARY OF THE INVENTION

Accordingly, it is a first object of the present invention to enable a warp mending device to mend a broken warp irrespective of a breakage position of the broken warp.

To achieve the first object of the present invention, the warp mending device comprises: a yarn guide for feeding a mending yarn by air current between a drop wire and a heddle corresponding to the broken warp; a nozzle for generating air current in a yarn guide line in the drawing direction; a yarn leading device for drawing the mending yarn from a bobbin to a slot of the drop wire or a mail of the heddle positioned at the upper stream of the drawing direction and for leading the mending yarn to an inlet of the yarn guide line and a positioning device for positioning an outlet of the yarn guide line to the slot of the drop wire or the mail of the heddle positioned downstream of the drawing direction.

When the warp is broken, the yarn leading device draws the mending yarn unwound from the bobbin into, e.g. the slot of the drop wire positioned upstream and leads the mending yarn to the inlet of the yarn guide line. At this state, the nozzle can draw the mending yarn from the yarn guide line to the mail of the heddle by generating air current in the yarn guide line in the drawing direction. At this time, inasmuch as the positioning device has previously positioned the heddle relative to the outlet of the guide line, the mending yarn is drawn into the mail of the heddle from the outlet of the yarn guide line. In such a manner, the mending yarn can be drawn into the slot of the drop wire and the mail of the heddle so that the loom can be restarted.

According to the yarn mending device set forth above, the mending yarn is drawn afresh into the drop wire and the heddle and thereafter the mending yarn is connected to the broken warp at the let-off side so that the broken warp can be mended even if one of the warps is broken at the portion adjacent to the drop wires or the heddles. That is, the warp mending device can perform its function irrespective of the breakage position of the broken warp. Furthermore, since the mending yarn can be drawn into the slot of the drop wire and the mail of the heddle by air current, the mending operation of the broken warp can be expedited accordingly.

Still furthermore, the yarn guide is disposed between the drop wires and the heddle and the mending yarn can be fed with certainty so that the yarn can be guided without interfering with other members. In addition to that, the positioning device can position the yarn guide line relative to the mail of the heddle so that the drawing operation can be made with certainly without utilizing a special drawing means such as a needle.

It is a second object of the present invention to establish the positional relationship between the drawing means and the heddle and between the heddle frame and the broken warp so that the positioning between the drawing means and the mail of the heddle can be effected precisely, whereby the warp mending device according to the present invention can be utilized commonly by various looms.

To achieve the second object, the warp mending device comprises a reference portion positioned at the side of the yarn drawing device and having a positional relationship with the drawing means wherein one of the drawing means and/or the heddle frame corresponding to the drawing means can be vertically moved so that the reference portion is directly brought into contact with the heddle frame or opposite to the heddle frame by a predetermined interval so as to relatively position the heights of both the reference portion and the heddle frame at a predetermined position, whereby the drawing means is positioned precisely relative to the mail of a particular heddle.

When the warp is broken during the weaving operation, the yarn detector deduces the dropped drop wire and detects the broken warp in the width direction of the loom. At the same time, a discriminator discriminates the heddle frame corresponding to the dropped drop wire on the basis of the identification code given to the dropped drop wire.

The yarn leading device guides, after discrimination of the identification code of the dropped drop wire by the discriminator, the drawing device from the standby position to the breakage position of the broken warp, where the drawing means is vertically moved relative to the heddle frame and the reference portion is positioned relative to the heddle frame in a predetermined relationship so that the drawing means and the mail of the heddle can be precisely positioned. Alternatively, the drawing means is displaced toward the reference portion by the heddle frame corresponding to the broken warp while the heddle frame corresponding to the broken warp and the drawing means are vertically moved toward each other so that the heddle frame is positioned relative to the reference portion according to a predetermined positional relashionship whereby the drawing means and the mail of the heddle can be precisely positioned.

Thereafter, the drawing means draws a new mending yarn into the mail of the heddle by a known drawing means such as an air current or a drawing means such as a needle. Thereafter, before the drawing operation, the new mending yarn is connected to the broken warp at the let-off side. Thereafter, the mending yarn can be connected to the broken warp at the take-up side at the other end thereof or drawn into the reed and woven in the texture of the fabric while it is held at the cloth fell when the loom is restarted.

According to the positioning operation set forth above, the heddle frame corresponding to the broken warp is brought into contact with or spaced at in a predetermined interval relative to the reference portion of the drawing device so that the drawing means and the mails of the heddles supported by the heddle frame can be precisely positioned in a vertical relationship with each other. Accordingly, the positioning precision is enhanced and the drawing operation accompanied by the precise positioning operation is assured by restricting the moving range of the drawing device alone relative to the heddle frame.

If the heddle frame is of the same model type, the positioning device is commonly used for a different model type of the loom or a plurality of looms of the same model type and can be incorporated in various looms or in the looms of the same model type.

BRIEF DESCRIPTION OF THE DRAWINGS

FIGS. 7 to 12 are views showing a warp mending device according to a modified example in which FIG. 7 illustrates a positioning device, FIGS. 8 and 9 illustrate yarn guides, FIGS. 10 and 11 illustrate drawing operations and FIG. 12 illustrates a yarn leading device;

DESCRIPTION OF THE PREFERRED EMBODIMENT

First Embodiment (FIGS. 1 to 6)

Figure 1:
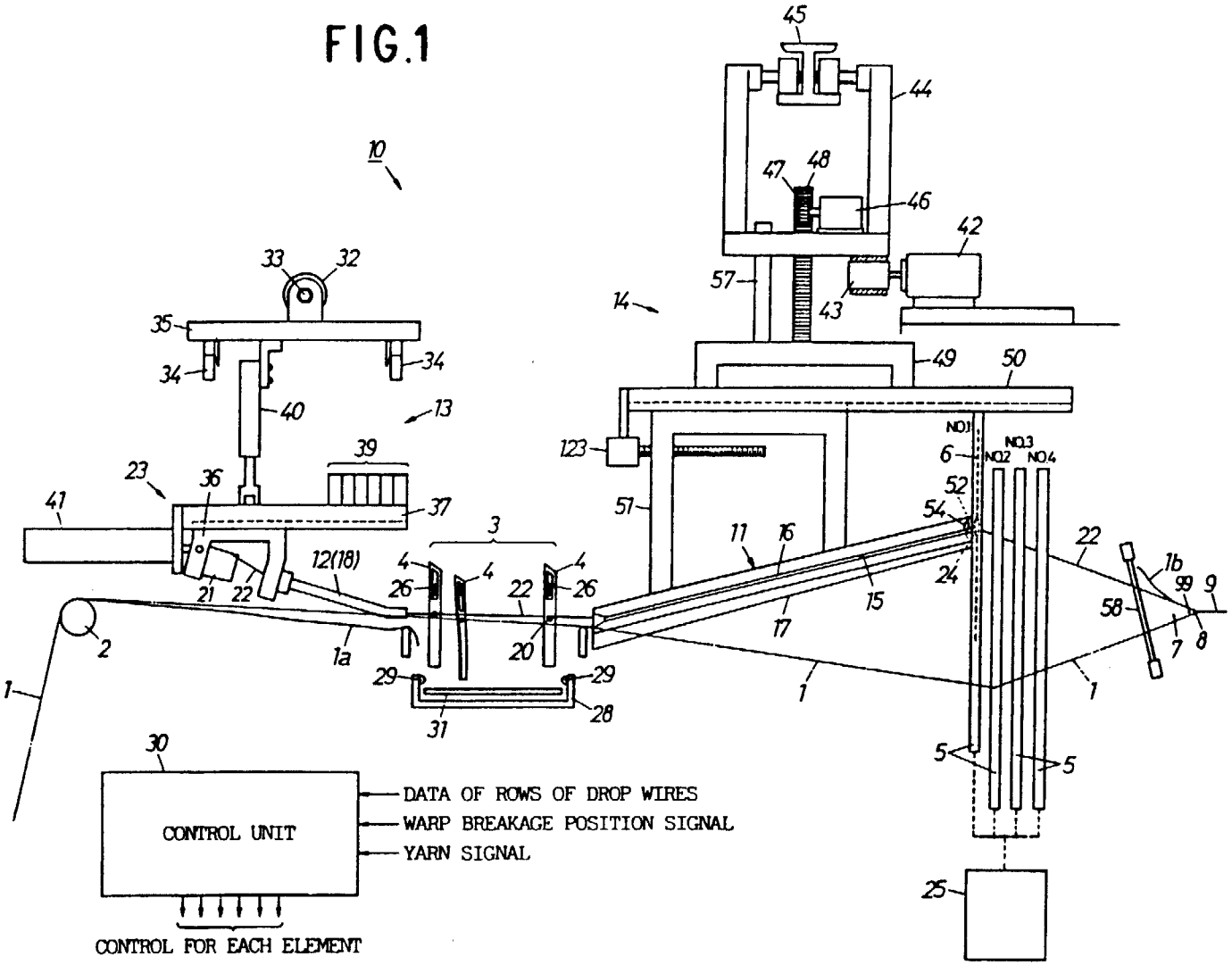
FIG. 1 is a side elevational view of a warp mending device according to a first embodiment of the present invention.
Figure 2:
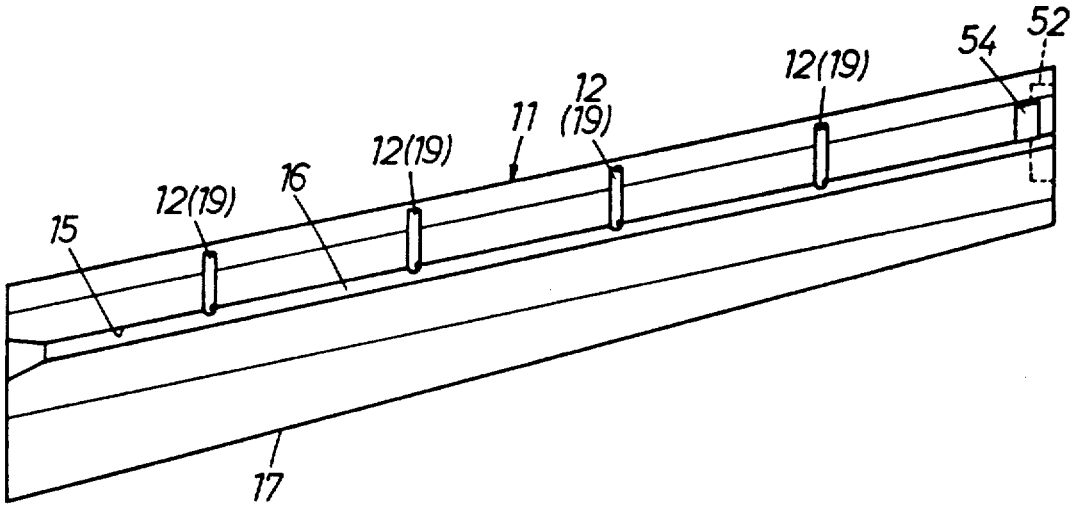
FIG. 2 is an enlarged side view of a yarn guide of the warp mending device of FIG. 1.
Figure 3:
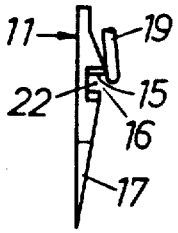
FIG. 3 is an enlarged front view of a yarn guide of the warp mending device of FIG. 1.

The warp mending device according to the first embodiment of the present invention will be described hereinafter.

A plurality of warps 1 arranged in a sheet is drawn into drop wires 4 of a warp stop motion 3 through a let-off roller 2 at the let-off side and further drawn into the mails of heddles 6 supported by heddle frames while a shed 7 is defined and interlaced with a weft 99 in front of a cloth fell 8 and woven as a fabric 9.

A yarn mending device 10 of the present invention comprises a yarn guide 11, a nozzle 12, a yarn leading device 13 and a positioning device 14.

The yarn guide 11 can be moved between the drop wires 4 and the heddle frames 5 corresponding to a trailing edge 1*a* and a leading edge 1*b* in a slightly inclined state in the width direction of a loom, in the direction of the warps 1 and in the vertical direction The yarn guide 11 has a part 16 communicating with the exterior along the longitudinal direction of a yarn guide line 15 in the drawing direction and also has a splitting guide 17 at the lower end thereof, if need be.

The splitting guide 17 becomes gradually thinner toward the lower end portion thereof and is inclined vertically along the direction of the warps at the tip end thereof. According to the first embodiment, the yarn guide line 15 has an inlet which is opened so as to be large at the end surface thereof; the amount of opening is narrowed toward an outlet of the yarn guide line 15.

The nozzle 12 comprises, according to the first embodiment, a drawing nozzle 18 of the yarn leading device 13 and a guide nozzle 19 provided along the yarn guide line 15 in which the air current in the drawing direction is generated within the yarn guide line 15.

The yarn leading device 13 draws a mending yarn 22 from a bobbin 21 into a slot 20 of the drop wire 4 from the let-off side and leads the mending yarn 22 toward the inlet of the yarn guide line 15 and comprises the nozzle 18 and feeding means 23.

Figure 5:
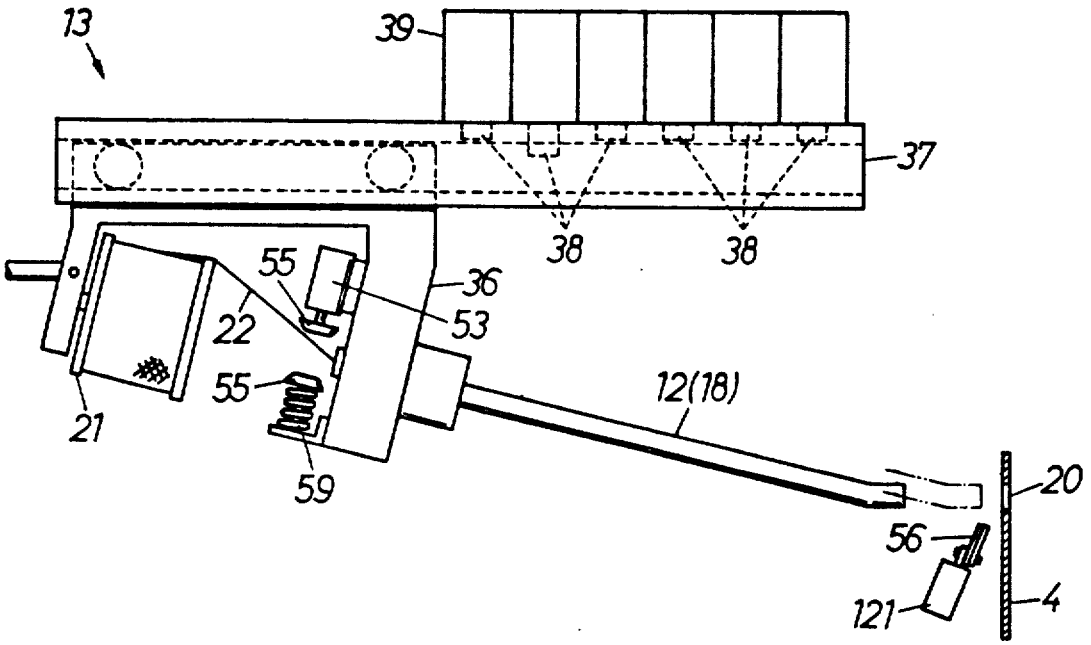
FIG. 5 is a side view of a yarn leading device of the warp mending device of FIG. 1.
Figure 6:
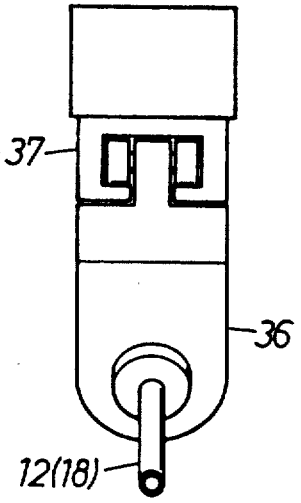
FIG. 6 is a front view of a yarn leading device of the warp mending device of FIG. 1.
Figure 7:
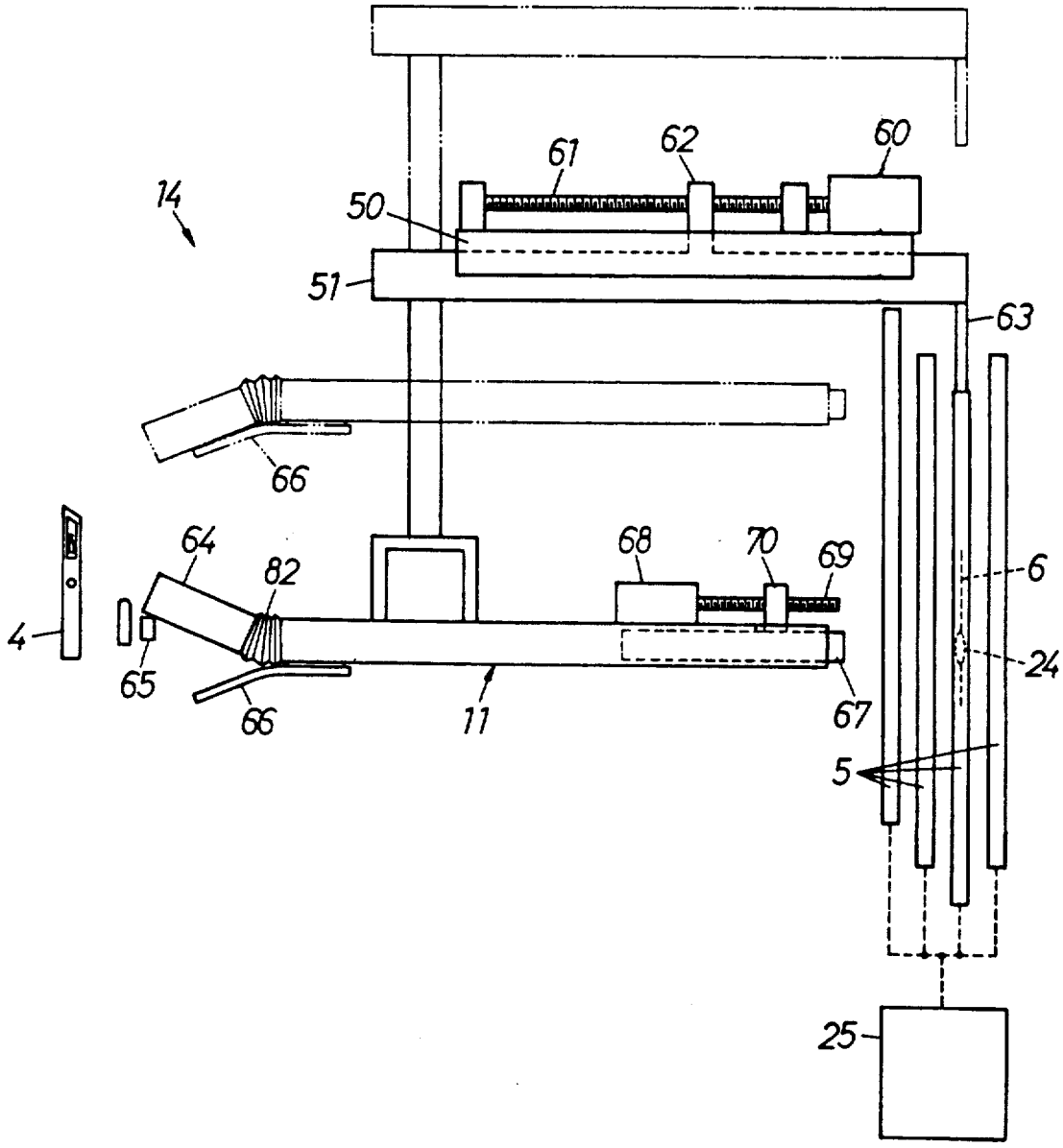
Figure 8:
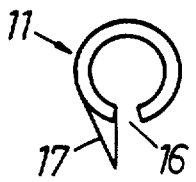

The nozzle 18 is, as illustrated in FIG. 1, FIG. 5 and FIG. 6, attached to a nozzle holder 36 together with the bobbin 21 with an appropriate inclination in which the nozzle holder 36 can be moved by an air cylinder 41 along the groove of a guide frame 37 in the direction of the warps 1 and is restricted at the fowarding end by a plurality of stoppers 38 corresponding to the number of rows of drop wires. The stoppers 38, each of which is driven by respective solenoids 39 upon reception of row data of drop wires, protrude inside the guide frame 37, thereby restricting the moving range of the nozzle holder 36. The guide frame 37 can be moved vertically by a vertical air cylinder 40 attached to a table 35 while it is held horizontal.

The positioning device 14 is provided for positioning the mail 24 of the heddle 6 relative to the outlet of the yarn guide line 15 and comprises, according to the first embodiment, a positioning member of the yarn guide 11 and a known leveling means 25 relative to each of the heddle frames 5.

When one of the warps 1 is broken during the weaving operation, the drop wire 4 corresponding to the broken warp 1 is dropped so that a warp stop signal is issued from the warp stop motion 3 to a control unit of the loom; hence, the loom is automatically stopped at a predetermined angular interval. At this time, a warp stop signal is generated at a contact lever 26 corresponding to the dropped drop wire 4 and is supplied to a control unit 30 as the row data of the drop wires. The control unit 30 includes therein programs necessary for execution of sequential warp mending operations and executes control of each element in the following manner.

Figure 4:
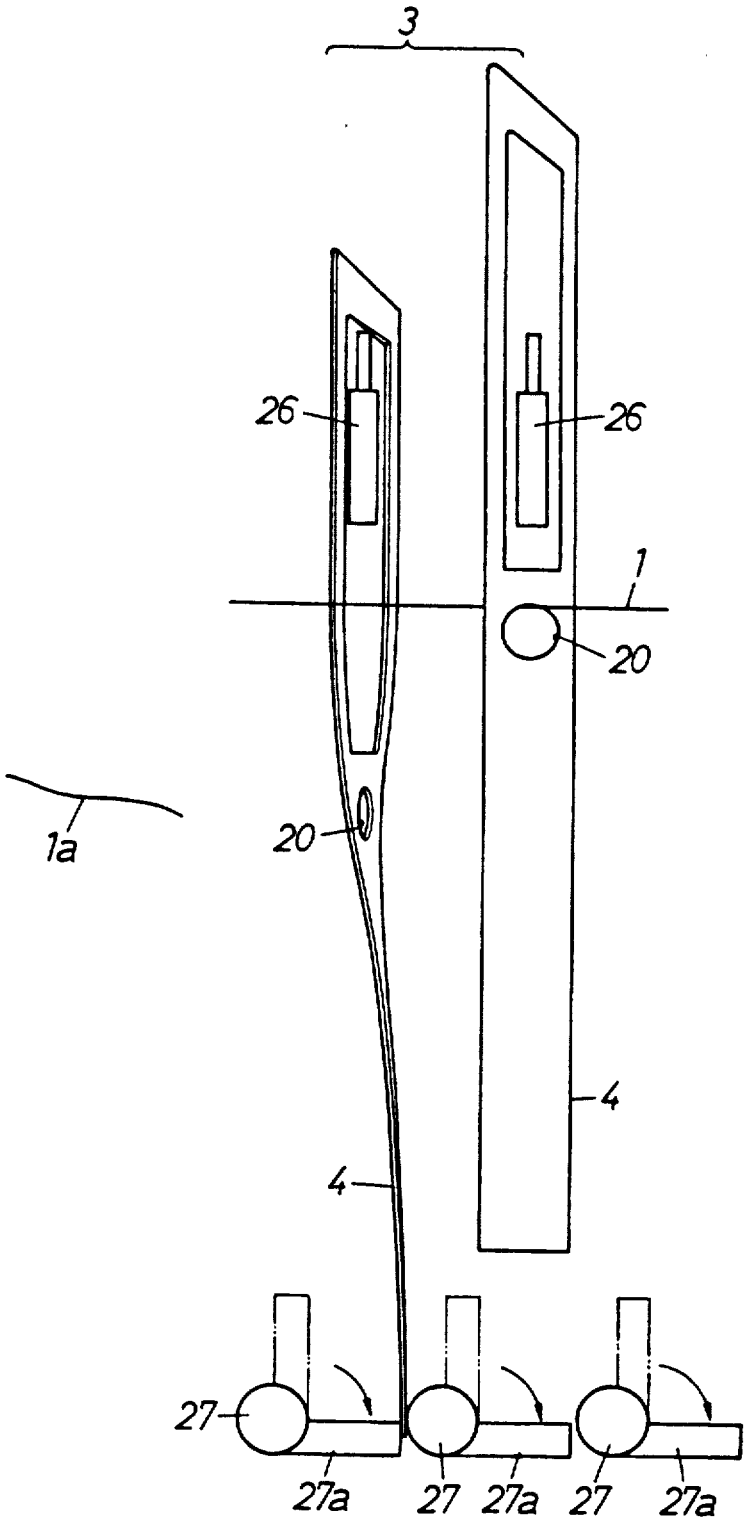
FIG. 4 is a view showing a state where drop wires of the warp mending device of FIG. 1 are twisted.

The control unit 30 turns twisting bars 27 all at once in the width direction of the loom clockwise at 90° as illustrated in FIG. 4. The two twisting bars 27 have respectively projection pieces **27*a* extending in the width direction of the loom and clamp the dropped drop wires 4 between the projection piece 27*a* and the adjacent twisting bar 27 while the lower ends thereof are turned substantially at 90° around vertical axes thereof. As a result, the slots 20 of the drop wires 4 are opposed to the drawing nozzle 18** at the wide areas.

Thereafter, a sensor holder 28 is moved from the standby position of the end of a selvage toward the width direction of the loom so that the dropped drop wires 4 can be detected by the lower portion of a pair of photo-sensors 29 and issues a yarn breakage position signal corresponding to the width direction of the dropped drop wires 4 to the control unit 30.

Subsequently, the dropped drop wire 4 is raised to the same height as the normal drop wires 4, if need be. The raising operation can be accomplished by raising a plate 31, which is rotatably supporting both ends of the twisting bar 27, to the lower ends of other normal drop wires 4 together with raising the twisting bar 27. The turning and raising of the dropped drop wires 4 can be effected by a gripper disclosed in Japanese Laid-Open Publication No. 63-28951 in which the gripper is raised and turned while holding the dropped drop wire 4.

Thereafter, since there is a possibility that both the trailing edge **1*a* and leading edge 1*b* are drawn into the slot of the drop wire 4 and the mail of the heddle 6, the control unit 30 starts the operation to remove both the trailing edge 1*a* and leading edge 1*b* from the slot of the drop wire 4 and the mail of the heddle 6**.

The removing operation can be made automatically using a removing device 91. The removing device 91 comprises a suction pipe 89 composed of a pair of winding rollers 93 and 94 and a gripper 95 and a cutter 97. The suction pipe 89 is operated by a driving unit, not shown, to move in the width direction of the loom over the portion adjacent to the let-off side of the warp stop motion 3. When the trailing edge **1*a* is removed from the drop wire 4, the suction pipe 89 is first moved toward the drop wire 4 corresponding to the trailing and leading edges 1*a* and 1*b*. The movement of the suction pipe 89 toward the drop wire 4 is first made on the basis of the signal issued by a pair of photosensors 29. Then, the suction pipe 89 is lowered by an air cylinder 85 while the suction pipe 89 carries out the suction operation. Thereafter, the trailing edge 1*a* is displaced in a U-shape while it is guided into slits 90 of the suction pipe 89 owing to the suction operation of the suction pipe 89. If a sensor 86 detects that the trailing edge 1*a* is displaced by a predetermined amount, the gripper 95 grips the trailing edge 1*a* at the feeding side rather than the side of the suction pipe 89 and the trailing edge 1*a* is cut by a cutter 97 between the gripper 95 and the suction pipe 89**.

Successively, one winding roller 94 is advanced to another winding roller 93 while the winding roller 93 is rotated by a motor 96 so that the trailing edge **1*a* at the winding side is removed. When the sensor 86 detects that the trailing edge 1*a* drawn into the drop wire 4 is removed, the suction pipe 89 operation is stopped. The suction pipe 89 delivers the trailing edge 1*a* at the feeding side to a knotter, not shown, so that the trailing edge 1*a* can be connected to the mending yarn, and returns to its original position or moves to a predetermined standby position while it grips the trailing edge 1*a***.

A removing device for removing the leading edge **1*b* drawn into the heddle 6 has the same construction as the removing device 91 except that the gripper 95 and the cutter 97 are provided in the reverse relation relative to those of the removing device 91. The removing device at the side of the heddle 6 is provided so as to be movable between a reed 58 and the cloth fell 8. After the leading edge 1*b* is removed, the leading edge 1*b*** at the side of the take-up side is kept in the suction state until the loom is restarted or is positioned to the portion where it does not hinder the loom from being restarted.

The winding rollers 93 and 94 are not always needed if both the trailing edge **1*a* and leading edge 1*b*** can be removed by the suction force alone.

Upon completion of the removal of both the trailing edge **1*a* and leading edge 1*b* from the drop wire 4 and the heddle 6, numbers of the heddle frames 5 corresponding to both the trailing edge 1*a* and leading edge 1*b* are detected. The numbers of the heddle frames 5 are directly detected by a heddle number detector as disclosed in Japanese Laid-Open Patent Publication No. 1-24673. There Publication No. 1-174649 discloses a device which discriminates a code of the dropped drop wire 4, while all the drop wires 4 are previously coded corresponding to the numbers of the heddle frame 5 in the order of drawing the warps 1, and indirectly detects the number of heddle frames on the basis of one of the codes given to the dropped drop wires 4. Alternatively, the numbers of the heddle frames 5 is detected by reading the frame numbers corresponding to both the trailing edge 1***a* and leading edge 1*b* by a warp breakage signal issued by the heddle frame 5 supporting the dropped heddle 6 when the warp is broken as disclosed in Japanese Laid-Open Patent Publication No. 46-39150 in which the heddle 6 supported by the heddle frame 5 incorporates a warp breakage detector therein.

The control unit 30 rotates, upon reception of the yarn breakage position signal issued by a pair of photosensors 29, a feeding motor 32 of the feeding means 23 for a predetermined number of revolutions, thereby driving a feeding screw unit 33 and moving the table 35 along a rail 34 disposed in the width direction of the loom so that the slot of the drop wire 4 is positioned at the line extending from the central line of the drawing nozzle 18.

The yarn leading device 13 receives a control command from the control unit 30 and drives the the vertical air cylinder 40 vertically so that the tip end of the drawing nozzle 18 is moved to the height of the slot 20 of the drop wire 4 while the nozzle holder 36 is moved toward the drop wires 4 by the air cylinder 41. The moving range at this time is restricted by the stopper 38 corresponding to the rows of the drop wires 4. Accordingly, after the movement of the tip end of the drawing nozzle 18 and the nozzle holder 36, the tip end of the drawing nozzle 18 is directed to approach the slot 20 of the drop wire 4 corresponding to the trailing edge 1*a* and leading edge 1*b*.

The positioning device 14 moves, upon reception of the command issued by the control unit 30, the yarn guide 11 as the drawing means from the standby position along the width direction of the loom so that the yarn guide 11 can be positioned at a predetermined height. That is, the control unit 30 first controls the rotation of the feeding motor 42 on the basis of yarn breakage signal, thereby driving a feeding belt driving pulley 43 so that a frame 44 having wheels is moved along a rail 45 in the width direction of the loom. The control unit 30 further rotates a raising motor 46 having a stop mechanism therein whereby a rack 48 meshing with a pinion 47 by rotation of the raising motor 46 is moved downward, thereby lowering a stay 49 and a guide frame 50 along a guide bar 57 so that a holder 51 serving also as a slider is moved in the direction of warp 1 relative to the guide frame 50 and the yarn guide 11 supported by the holder 51. The relative positioning between the warp 1 and the heddle 6 is effected by lowering the guide yarn until the lower surface of the guide frame 50 forming the reference portion of the drawing means contacts the upper surface of the heddle frame 5 corresponding to both the trailing edge 1*a* and leading edge 1*b* which are previously moved to the portion higher than the other heddle frames 5 by the operation of the leveling means 25 in a predetermined amount.

During the lowering of the yarn guide 11 is lowered, the lower end of the splitting guide 17 enters the warp 1 adjacent to the trailing edge 1*a* and leading edge 1*b* and splits the warps 1 at both sides thereof so that the yarn guide 11 can enter the plurality of normal warps 1 adjacent to both the trailing edge 1*a* and leading edge 1*b* with ease. At the state where the lower surface of the guide frame 50 is brought into contact with the upper surface of the heddle frame 5, the heights of the inlet and the outlet of the yarn guide line 15 respectively conform to the heights of the slot 20 of the drop wire 4 and the mail 24 of the heddle 6. Furthermore, the positioning device 14, upon reception of the command from the 30, rotates a motor feeding means 23 for a predetermined number of revolutions on the basis of the number of the heddle frame 5 corresponding to both the trailing edge 1*a* and leading edge 1*b* so that the exit of the yarn guide line 15 is advanced toward the mail 24 of the heddle 6 by way of the guide frame 50.

The outlet of the yarn guide 11 is provided with a magnet 52 and a V-shaped heddle guide so as to attract the heddle 6 thereto so that the mail 24 of the heddle 6 conforms to the outlet of the yarn guide line 15 with certainty. Inasmuch as the inlet opening of the yarn guide line 15 is large, even if the heights of the warp line is slightly varied depending on the loom, there is no likelihood that the height of the inlet of the yarn guide line 15 does not conform to that of the slot 20 of the drop wire 4.

Thereafter, the mending yarn 22 unwound around the bobbin 21 is inserted inside the drawing nozzle 18 and drawn into the slot 20 of the drop wire 4 corresponding to both the trailing edge 1*a* and leading edge 1*b* together with the jetted fluid, and then fed into the yarn guide line 15 of the yarn guide 11 and drawn into the mail 24 of the heddle 6. During this period, the nozzle 12, i.e. the drawing nozzle 18 and the guide nozzle 19 cooperate with each other for generating air current along the yarn guide line 15 in the drawing direction and successively unwind the mending yarn 22 from the bobbin 21.

The mending yarn 22 reached the heddle 6 is confirmed by a yarn signal issued by a yarn sensor 54. Accordingly, after the confirmation, the nozzle 12, i.e. the drawing nozzle 18 and the guide nozzle 19 automatically stop jetting the fluid under pressure while a pair of clampers 55 provided between the bobbin 21 and the inlet of the drawing nozzle 18 clamp the mending yarn 22 by the force generated between a solenoid 53 and a spring 59 and retains the mending yarn 22 for a moment. If the presence of the drawing nozzle 18 is not detected by the yarn sensor 54 within a predetermined time, the control unit 30 issues an alarm which is notified outside by means of sound or light.

Thereafter, the clampler 55 releases the mending yarn 22 by the operation of the solenoid 53 so that air cylinder 41 moves the drawing nozzle 18 backward, i.e. it moves leftward in FIG. 1 and the mending yarn 22 is guided to the knotter, not shown, provided at the rear portion of the drop wires 4. Accompanyed by the movement of the drawing nozzle 18, the mending yarn 22 is unwound from the bobbin 21. If the mending yarn 22 is clamped by the clampler, not shown, at the outlet of the yarn guide line 15 when the drawing nozzle 18 is retracted, the mending yarn 22 can be unwound from the bobbin 21 with certainty. After the mending yarn 22 is connected to the trailing edge 1*a*, the connected trailing edge 1*a* and the mending yarn 22 are cut by a cutter 56 movable forward by the actuation of a solenoid 121. The knotter is provided between the drop wires 4 and the let-off roller 2 and movable in the width direction of the loom together with the drawing nozzle 18. As shown in FIG. 1, the drawing nozzle 18 is illustrated to move backward at maximum at the portion adjacent to the let-off side of the warp stop motion 3, but it is practically movable toward the let-off roller 2 so that the mending yarn 22 can be guided by the knotter.

The knotter connects the trailing edge 1*a* to one of the mending yarn 22 by connecting the trailing edge 1*a* at the beam side guided manually or by the removing device 91. The mending yarn 22 drawn into the mail of the heddle 6 is, transferred to a reed drawing device, not shown, and drawn into the dents of a reed manually or by the reed drawing device.

Thereafter, each of the components of the yarn mending device 10 completes the warp mending operation and returns to the original position so as to be kept ready for the next mending operation. During the raising operation of the yarn guide 11, the mending yarn 22 is not influenced by the raising operation since the mending yarn 22 inside the yarn guide line 15 passes the cut-off part 16 and slips out of the yarn guide 11. At this state, the loom is kept ready for restarting.

The connection of the trailing edge 1*a* and the mending yarn 22 may be made by the operator without resorting to the knotter. In this case, the time for involving in the connection operation can be reduced since the mending yarn 22 is drawn into the slot of the drop wire 4 or the mail of the heddle 6.

Modified Embodiment (FIGS. 7 to 12)

A warp mending device according to modified embodiments will be described with reference to FIGS. 7 to 12.

The components in the modified embodiments which are the same as those of the first embodiment are denoted by the same numerals and the explanation thereof is omitted.

A positioning device of the warp mending device comprises the guide frame 50 which is movable vertically and which is composed of a feeding motor 60, a feeding secrew 61 and a feeding nut 62, the holder 51 serving as the slider being positioned relative to the direction of the warp 1 and a reference portion 63 attached to the holder 51 and movable over the heddle frame 5 corresponding to the trailing edge 1*a* and leading edge 1*b* as shown by the two dotted lines wherein the reference portion 63 is brought into contact with the upper surface of the heddle frame 5 when the guide frame 50 is lowered so that the yarn guide 11 and the heddle frame 5 are positioned relative to each other.

In this modified example, the leveling operation by the leveling means 25 is unnecessary at the time of the positioning operation. The yarn guide 11 comprises, as illustrated FIG. 8, a pipe having a C-shape in cross section and a slit serving as the cut-off part 16 at the lower end thereof. At the raising operation of the yarn guide 11, an auxiliary yarn guide 64 provided at the end portion of the feeding side is attached to the yarn guide 11 by a bellows 82 and is directed downward by a positioning member 66 but contacts a stopper 65 at the fixed position so that the auxiliary yarn guide 64 is directed upward so as to be relatively positioned relative to the warp stop motion 3.

An auxiliary yarn guide 67 provided at the rear portion of the feeding side is arranged inside the yarn guide 11 and movable backward by a feeding motor 68, a feeding screw 69 and a feeding nut 70. When the lowering operation of the yarn guide 11 is completed, the feeding motor 68 is rotated for a predetermined number of rotations so that the yarn guide 11 can approach the mail 24 of the heddle 6 corresponding to the trailing edge 1*a* and leading edge 1*b*. The state of communication beween the yarn guide 11 and the mail 24 of the heddle 6 can be made by cooperation of the forward movement of the yarn guide 11 and the approach of the heddle 6 to the outlet of the yarn guide line 15 by another device. It is a matter of course that the relative position between the yarn guide 11 and the mail 24 of the heddle 6 is not displaced after the completion of the positioning thereof if the magnet 52 is attached to the outlet of the auxiliary yarn guide 62 in the same manner as in the first embodiment.

Figure 9:
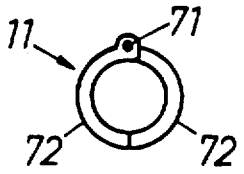

The yarn guide 11 may comprise, as illustrated in FIG. 9, two guide parts 72 and a pin 71 provided at the upper end of the guide parts 72 for pivotally connecting both the guide parts 72. When the mending yarn 22 is guided, the pair of guide parts 72 are brought into contact with each other at the lower end portions thereof which does not define the cut-off part 16 but when the mending yarn 22 is picked up, the cut-off part 16 is defined by opening the lower end portion thereof about the pin 71.

The positioning operation between the heddle frame 5 and the yarn guide 11 is not limited to the case where the reference portion 63 is brought into contact with the heddle frame 5 but includes the case where the heddle frame 5 corresponding to the trailing edge 1*a* and leading edge 1*b* is stopped at the predetermined shedding position, and then the yarn guide 11 is lowered for the predetermined moving range and thereafter the yarn guide line 15 and the mail 24 of the heddle 6 are positioned relative to each other in the vertical direction.

Figure 10:
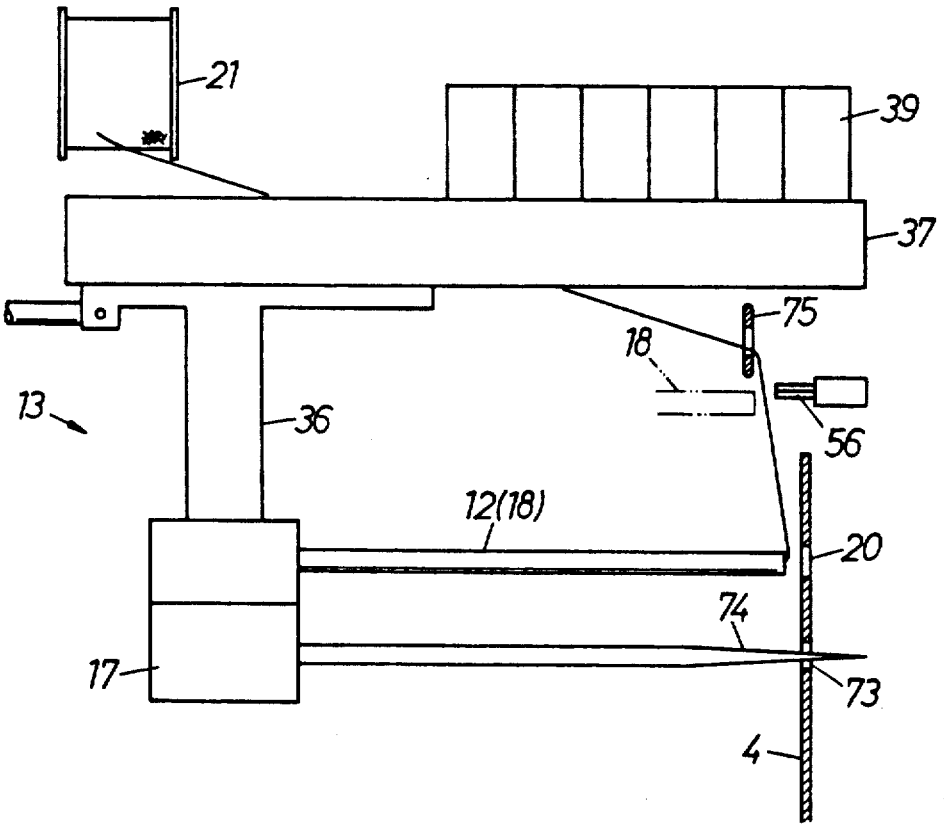

The drawing operation of the mending yarn 22 into the slot 20 of the drop wire 4 can be made, as illustrated in FIG. 10, by penetrating the drawing nozzle 18 per se, which has an outer diameter less than the slot 20 of the drop wire 4, and into the slot 20 of the drop wire 4, thereafter moving the tip end of the drawing nozzle 18 toward the inlet of the yarn guide line 15 and jetting the air under pressure therefrom. If the drop wire 4 has a positioning hole 73, the drawing operation of the mending yarn 22 can be made by providing a needle 74 at the yarn leading device 13 at the portion corresponding to the positioning hole 73 and inserting the needle 74 into the positioning hole 73 to assure the drawing operation between the mending yarn 22 and the slot 20 of the drop wire 4.

The drawing nozzle 18 is not limited to the type for leading the mending yarn 22 from the rear end portion thereof but includes the type capable of drawing the mending yarn 22, which has at least the length extending from the tip end of the drawing nozzle 18 to the yarn guide 11 so as to transfer the mending yarn 22 to the yarn guide 11 at the portion adjacent to the yarn guide 75, together with air current, penetrating the slot 20 of the drop wire 4 and thereafter transferring the mending yarn 22 to the FIG. yarn guide 11.

Figure 11:
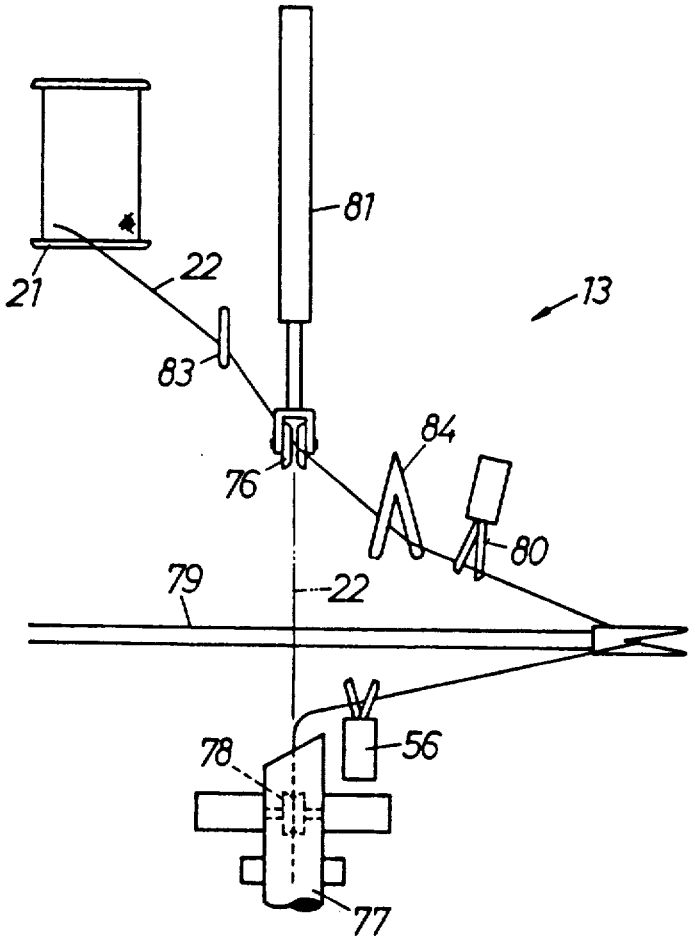
Figure 12:
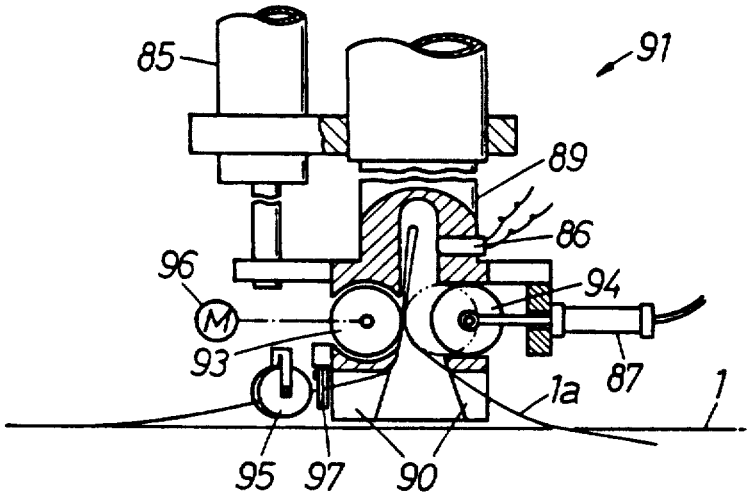

Furthermore, according to the yarn leading device 13 as illustrated in FIG. 11, the mending yarn 22 lead from a yarn guide 83 is held by a pair of clampers provided inside a suction pipe 77 and is caught by a needle 79 and drawn into the slot 20 by the forward movement of the needle 79. That is, the mending yarn 22 extended between the pair of clamplers 76 and the pair of clampers 78 is caught by the advancing needle 79. At this time, since the mending yarn 22 is released from the pair of clampers 76, the mending yarn 22 is drawn into the slot 20 in the V-shape while it is unwound from the bobbin 21 and guided into the inlet of the yarn guide line 15.

Thereafter, the mending yarn 22 is cut by the cutter 56 at the portion adjacent to the suction pip 77 so that the mending yarn 22 is guided to the mail 24 of the heddle 6 by the jetted air from the plurality of guide nozzles 19 through the yarn guide line 15 while it is unwound from the bobbin 21. At this time, the pair of clampers 78 are released so that the tip end of the mending yarn 22 is discharged by the suction pipe 77. When the drawing operation is completed, the yarn leading device 13 is moved back toward the let-off side and the mending yarn 22 is guided to the knotter, not shown, and the mending yarn 22 and the trailing edge 1*a* are connected to each other. The mending yarn 22 connected to the bobbin 21 is again gripped by the pair of clampers 76 and cut by a cutter 80 between the yarn knotted portion and a V-shaped yarn guide 84. The tip end of the mending yarn 22 connected to the bobbin 21 is lowered together with the pair of clampers 76 by an air cylinder 81 and transfered to the suction pipe 77 and is kept for the ready for next threading.

According to the modified embodiment, since the mending yarn is first drawn into the slot 20 of the drop wire 4 and secondly the mail 24 of the heddle 6, the drawing operation is directed from the side of the warp stop motion 3 to the heddle frame 5 but may be vice versa. In the latter case, the yarn leading device 13 is provided at the take-up side of the heddle frame 5 and the direction of the inlet and outlet of the yarn guide line 15 is reversed.

The yarn leading device 13 draws the mending yarn 22 into the dents of the reed and the mail of the heddle 6 corresponding to the trailing edge 1*a* and leading edge 1*b* and guides the mending yarn 22 into the inlet of the yarn guide line 15 or the mending yarn 22 is first drawn into the heddle 6 and then the mending yarn 22 is guided into the yarn guide line 15 to complete the drawing operation between the heddle 6 and the drop wire 4; thereafter, the other means guides the mending yarn 22 into the dents of the reed. The yarn guide 11 moves, upon reception of the row data of the drop wires 4 corresponding to the trailing edge 1*a* and leading edge 1*b*, the outlet of the yarn guide line 15 toward the direction of the drop wire 4 so that the outlet of the yarn guide line 15 conforms to the slot 20 of the drop wire 4. The yarn leading device 13 is also moved toward the direction of the heddle 6.

Figure 13:
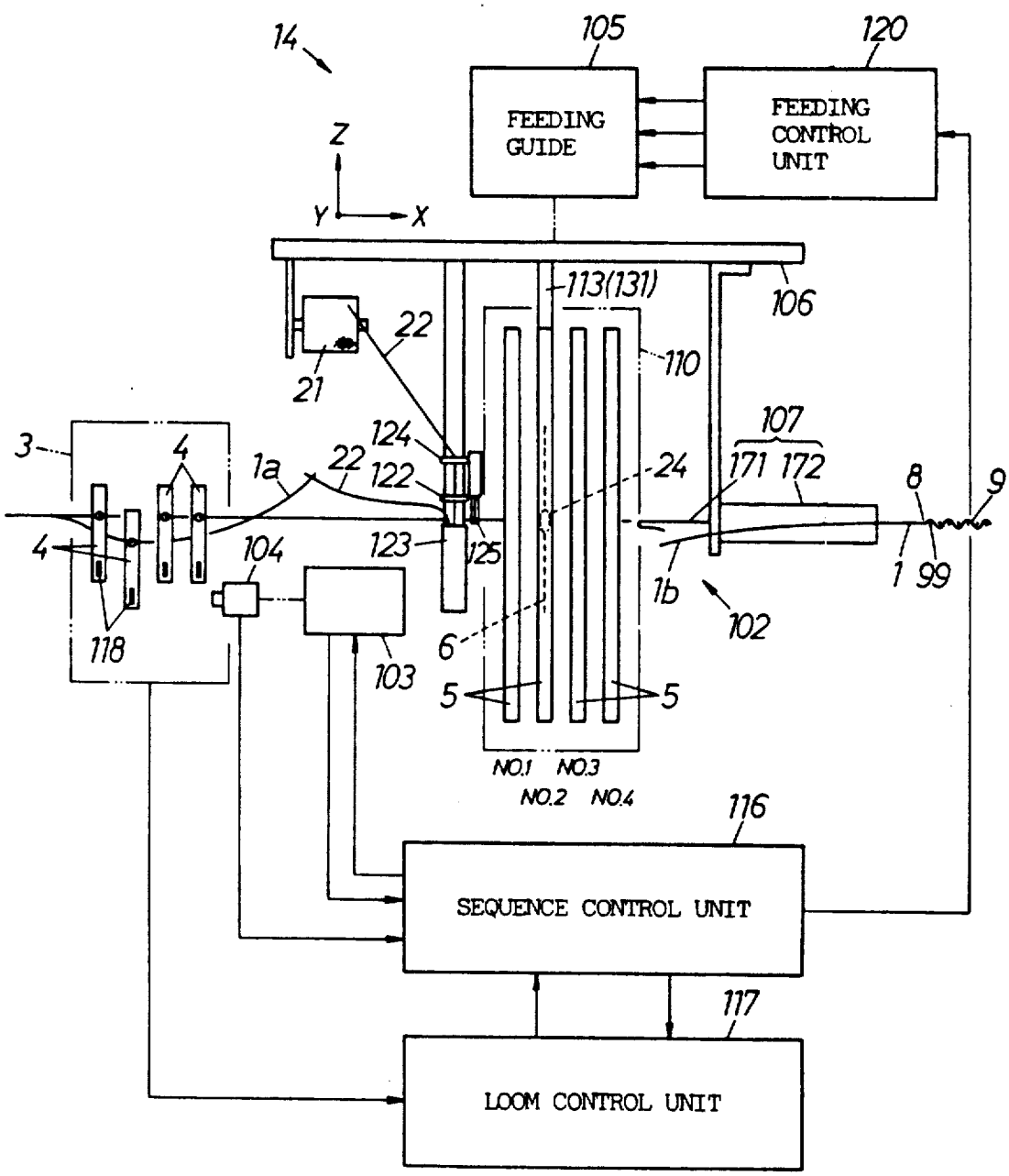
FIG. 13 is a schematic view showing a drawing device serving also as positioning device employed in a warp mending device according to a second embodiment of the present invention.
Figure 14:
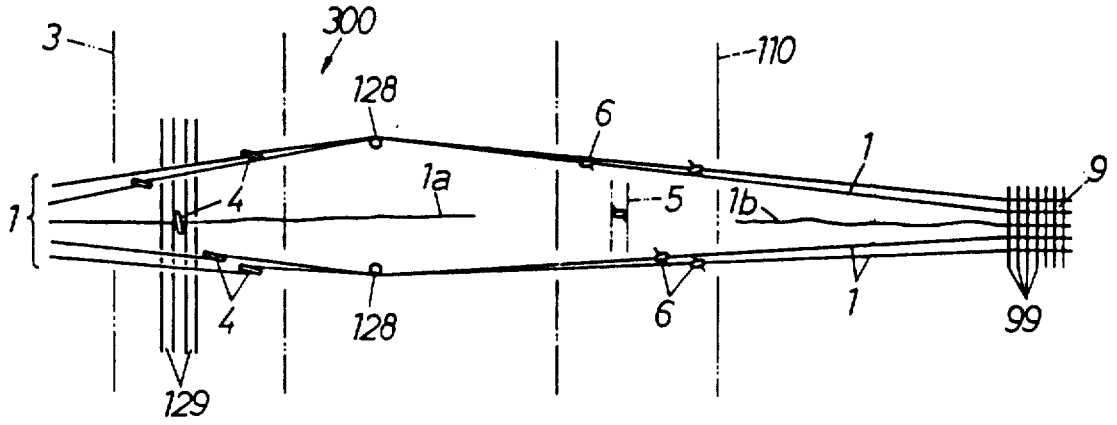
FIG. 14 a plan view showing a state where warps are separated.

Second Embodiment (FIGS. 13 and 14)

A warp mending device according to a second embodiment of the present invention will be described with reference to FIGS. 13 and 14.

The components in the second embodiment which are the same as those of the first embodiment and the modified example are denoted by the same numerals and the explanation thereof omitted.

The positioning device comprises a drawing device 102, a detector 103, a discriminator 104 and a feeding guide 105.

The drawing device 102 comprises a frame 106 provided with a drawing means 107 composed of an operation means 172 such as an air cylinder and a needle 171 movable into or away from the operation means 172 by the operation of the operation means 172 and a reference portion 113 provided with a reference member 131.

The plurality of warps 1 are arranged in a sheet and drawn into each slot of the drop wires 4 of the warp stop motion 3 arranged in, e.g. four rows, and drawn further into each mail 24 of the heddles 6 supported by the heddle frames 5 and interlace with the weft 99 and woven as a fabric.

When one of the plurality of warps 1 are broken during the weaving operation, the drop wire 4 corresponding to the broken warp 1 drops. The warp stop motion 3 supplies a warp stop signal to a loom control unit 117 which control unit 117 automatically stops the loom at a predetermined stopping angular interval and supplies an operation command to a sequence control unit 116.

At this state, a separation unit 300 as disclosed in Japanese Laid-Open Patent Publication 2-37801 clamps the dropped drop wires 4 at the lower ends thereof by a pair of bars 129, as shown in FIG. 14, so that the dropped wires 4 are twisted at approximately 90° and separates the other warps 1 adjacent to the trailing edge 1*a* and leading edge 1*b* from the trailing edge 1*a* and leading edge 1*b* by the drop wires 4, and a pair of separation members 128 are inserted into the space defined between the drop wires 4 and the trailing edge 1*a* and leading edge 1*b* and moved away from the trailing edge 1*a* and leading edge 1*b* by a necessary interval so that the trailing edge 1*a* and leading 1*b* edge are separated from the other normal warps 1.

Subsequently, the sequence control unit 116 first drives the detector 103 serving also as feeding guide on the basis of a predetermined operation sequences and then moves the discriminator 104 in the direction of Y in FIG. 13, i.e. the width direction of the loom, thereby deducing the position of the dropped drop wire 4 and detecting the moving range in the direction of Y. At the same time, as disclosed in Japanese Laid-Open Patent Publication No. 1-174649, the sequence control unit 116 discriminates the numbers of the corresponding dropped drop wire 4, i.e. No. 2 heddle frame 5 by reading by the discriminator 104 in which the identification codes previously affixed to all the drop wires 4 is stored in correspondence with the numbers of heddle frames identification code 118 affixed to the dropped drop wire 4. Alternatively, the sequence control unit 116 discriminates the No. 2 heddle frame 5 corresponding to the trailing edge 1*a* and leading edge 1*b* by detecting the rows of the drop wires 4 if the broken warp 1 which corresponds both to the rows of drop wires 4 and the numbers of the heddle frames 5 is drawn into the slot of the drop wire 4, and supplies the data of the heddle frame 5 and the data of the weaving direction to, e.g. a feeding control unit 120 of the feeding guide 105 such as a three-dimensional orthogonal coordinate.

It is also possible to first detect the position of the dropped drop wire 4 in the width direction of the loom by the detector 103, secondly grip the dropped drop wire 4 by a gripper as disclosed in Japanese Laid-Open Patent Publication No. 63-28951, then turn and twist the gripper and thereafter read the identification code of the dropped drop wire 4 after the gripper is twisted. The feeding contol unit 120 receives the weaving direction data, i.e. Y direction data under the numerical control system, moves the drawing device 102 together with the frame 106 from the standby position to the position adjacent to the trailing edge 1*a* and leading edge 1*b*, then moves the drawing device 102 to the position of the No. 2 heddle frame 5 corresponding to the trailing edge 1*a* and leading edge 1*b*, i.e. in the direction of the warp 1 or X direction. Thus, the reference portion 113 is positioned over the No. 2 heddle frame 5 and the drawing device 102 is lowered together with the frame 106 until the reference member 131 of the reference portion 113 can contact the upper surface of the No. 2 heddle frame 5. As a result, the drawing device 102 is confronted with the heddle 6 of the No. 2 heddle frame 5 while the mail 24 of the heddle 6 is positioned at the advancing line of the needle 171.

Thereafter, the knotter or the operator knots the mending yarn 22 unwound from the bobbin 21 to the trailing edge 1*a* at the let-off side which mending yarn 22 is held stretched between a yarn guide 124, a loose clamper 122 and a suction holder 123. The operation means 172 moves the needle 171 to the direction of the heddle 6 and draws the needle 171 into the mail 24 of the heddle 6 whereby the needle 171 catches the mending yarn 22 between the loose clampler 122 and the suction holder 123 and moves backward so that the mending yarn 22 is drawn into the mail 24 of the heddle 6.

The mending yarn 22 between the bobbin 21 and the needle 171 is cut by the cutter 125 at the portion adjancent to the loose clamper 122 at an appropriate length and knotted to the leading edge 1*b* at the fabric side by the knotter or the operator. After completion of this operation, the feeding guide 105 moves the drawing device 102 backward to the standby position so that the loom can be restarted. The loom control unit 117 receives the starting command from the sequence control unit 116 to actuate the loom so that the loom starts the weaving operation.

According to the second embodiment, when the drawing device 102 is lowered, the reference member of the reference portion 113 contacts the upper surface of the No. 2 heddle frame 5 corresponding to the trailing edge 1*a* and leading edge 1*b* so that the needle 171 as the drawing means 107 can be precisely positioned relative to the mail 24 of the heddle 6 in concern.

The width of the reference member 131 is less than the thickness of the heddle frame 5 and the projection length of the reference member 131 is set to be greater than the vertical moving range of the heddle frame 5 so that the reference member 131 can contact the upper surface of the No. 2 heddle frame 5 even if the No. 2 heddle frame 5 is positioned at the lowest relative to the heddle frame 5 positioned at both sides of the No. 2 heddle frame 5.

Figure 15:
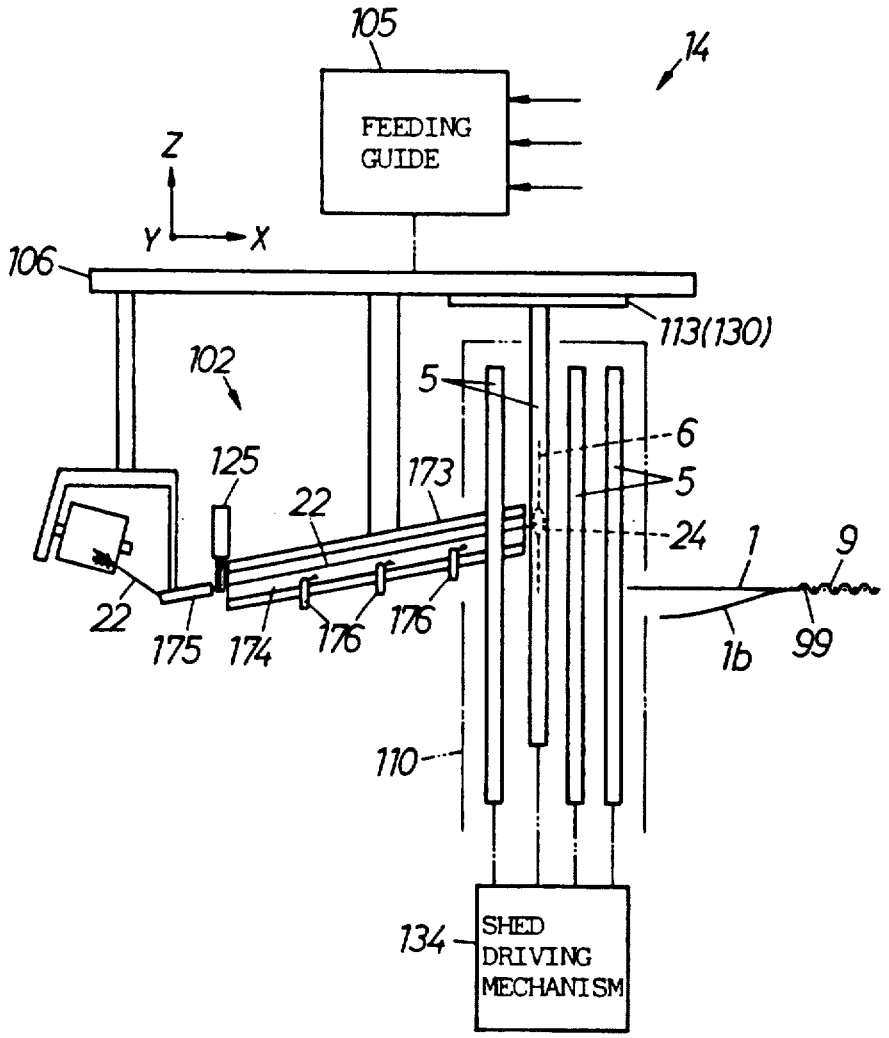
FIG. 15 is a side view of a main portion of a drawing device serving also as a positioning device employed in a warp mending device according to a third embodiment of the present invention.
Figure 16:
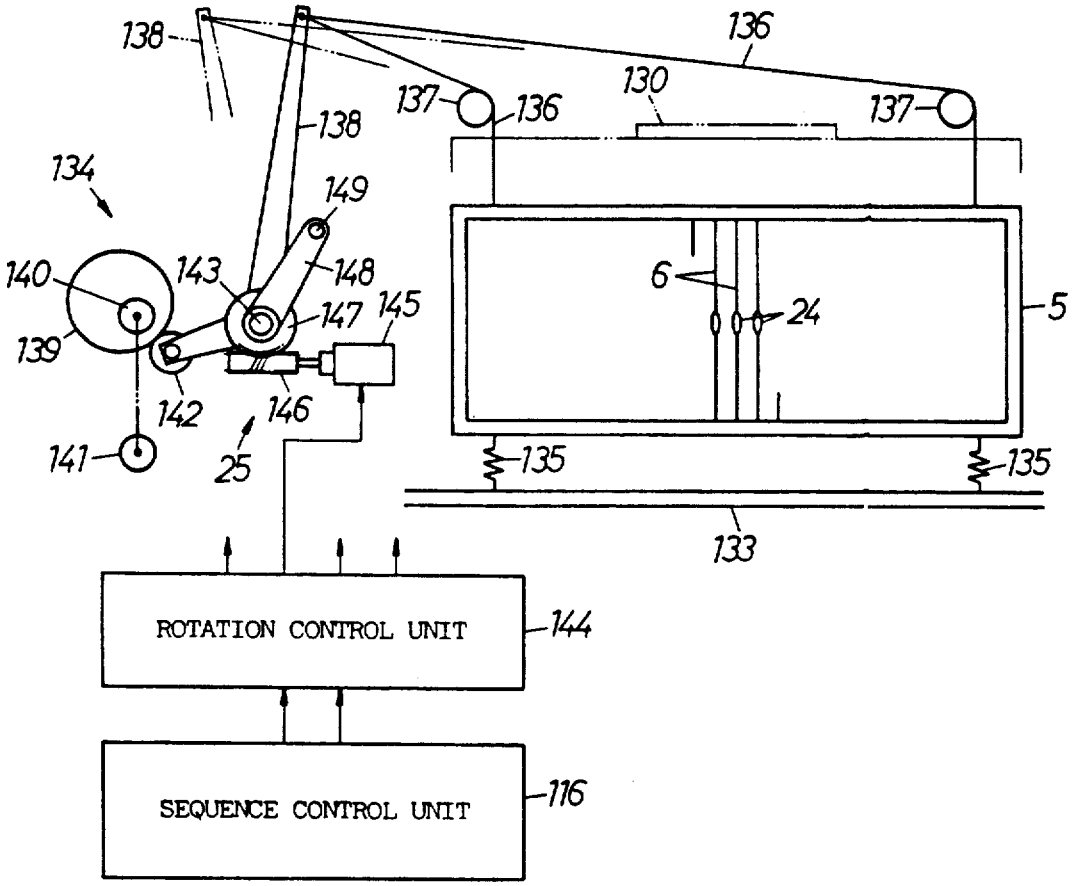
FIG. 16 is a schematic front view showing a shed driving mechanism and a leveling device of the drawing device serving also as a positioning device in FIG. 15.

Third Embodiment (FIGS. 15 and 16)

A warp mending device according to a third embodiment of the present invention will be described with reference to FIGS. 15 and 16 in which FIG. 15 shows a main portion of the positioning device 14 and FIG. 16 shows an example a cam type shedding driving mechanism 134 and the leveling device 25.

The components in the third embodiment which are the same as those of the first and second embodiments are denoted by the same numerals and the explanation thereof is omitted.

A reference plae 130 as the reference portion 113 has a width confronted to and corresponding to all the upper portions of the heddle frames 5. The reference member 130 is lowered by the feeding guide 105 to the predetermined position over the heddle frames 5, and is thereafter moved in the direction of X in FIG. 15 to reach the end of a yarn guide 173 serving as the drawing means 107 and approaches the portion adjacent to the No. 2 heddle frame 5 corresponding to the trailing edge and leading edge of the 1*b* of the broken warp 1.

The yarn guide 173 has a shape substantially same as the yarn guide 11 and a guide groove 174 at one side thereof. The yarn guide 173 feeds the mending yarn 22 together with the air current jetted from the drawing nozzle 175 and air current jetted from the plurality of delivering nozzles 176 to the portion adjacent to No. 2 heddle frame 5 corresponding to the trailing edge 1*b* and leading edge 1*b* and draws the mending yarn 22 into the mail 24 of the heddle 6 so that the mending yarn 22 is projected from the mail 24 of the heddle 6 toward the take-up side.

The No. 2 heddle frame 5 corresponding to the trailing edge 1*a* and leading edge 1*b* is driven by a cam type shedding driving mechanism 134 so that it is raised upward and brought into contact with a lower surface of the reference plate 130 at the upper end thereof.

FIG. 16 shows an example of the cam type shedding driving mechanism 134 and the leveling device 25. Each heddle frame 5 is biased downward by a drawing spring 135 at the lower both ends of the heddle frame 5 and connected to one end of a shedding lever 138 by two guide pulleys 137 and hanging wires 136 and is driven by each of cams 139 having different phase angles.

The shedding lever 138 is rotatably supported by a lever shaft 143. A cam shaft 140 used in common for four cams 139 is interlocked with a main shaft 141 of the loom and rotates at a predetermined speed reducing ratio for delivering the shedding lever 138 a swing motion around the lever shaft 143 by way of cam rollers 142 contacting the outer peripheries of the cams 139 so that the heddle frame 5 is vertically driven and the warps 1 are subjected to shedding.

At the time of positioning the No. 2 heddle frame 5 relative to the reference plate 130, the sequence control unit 116 supplies a rotation control unit 144 the frame number of the heddle frame, i.e. the No. 2 heddle frame 5 corresponding to the trailing edge 1*a* and leading edge 1*b*. The rotation control unit 144 of the leveling device 25 rotates only a motor 145 for operating the shedding lever 138, thereby rotating a leveling lever 148 counterclockwise in FIG. 16 by way of a worm 146 and a worm wheel 147 whereby the shed lever 138 is forced to rotate counterclockwise around the lever shaft 143 so that the No. 2 heddle frame 5 alone is raised until it is brought into contact with the reference plate 130 at the upper portion thereof. The contact between the upper portion of the No. 2 heddle frame 5 and the reference plate 130 can be detected by a sensor such as a piezoelectric element or limit switch provided at the upper portion of the No. 2 heddle frame 5 or the lower surface of the reference plate 130.

The leveling lever 148 is incorporated in the worm wheel 147 and rotatably supported by the lever shaft 143. The leveling lever 148, the worm wheel 147, the lever shaft 143 together with the motor 145 and the worm 146 are provided for each shedding lever 138. The leveling device 25 having the structure set forth above can raise the No. 2 heddle frame 5 alone corresponding to the trailing and leading edges 1*a* and 1*b*, thereby allowing the upper portion of the No. 2 heddle frame 5 to contact the reference plate 130 as the reference portion 113 so that the mail 24 of the heddle 6 supported by the No. 2 heddle frame 5 is vertically positioned with accuracy relative to an end of the yarn guide 173 as the drawing means 107.

After completion of the positioning between the mail 24 of the heddle 6 and the yarn guide 173, a drawing nozzle 175 inserts the mending yarn 22 together with air current inside a guide groove 174 of the guide yarn 173 and moves the mending yarn 22 along the guide groove 174 together with air current from a plurality of delivering nozzles 176 and draws the mending yarn 22 into the mail 24 of the heddle 6, the mending yarn 22 being is drawn in the direction of the woven fabric 9. The mending yarn 22 is, after it is drawn in the direction of the woven fabric 9, cut by the cutter 125 between the yarn guide 173 and the drawing nozzle 175 and the cut end of the mending yarn 22 is connected to the trailing edge 1*a* at the let-off side by the operator or an automatic knotter.

Upon completion of the operation, the sequence control unit 116 reversely rotates the motor 145 by way of the rotation control unit 144 to return the heddle frame 5 corresponding to the trailing and leading edges 1*a* and 1*b* to its original height, i.e. its vertical position.

According to the third embodiment, the heddle frame 5 corresponding to the trailing and leading edges 1*a* and 1*b* is raised by the leveling device 25 after the drawing device 102 is lowered to the predetermined position so that the upper portion of the heddle frame 5 is brought into contact with the reference portion 113 whereby the mail 24 of the heddle 6 supported by the particular heddle frame 5 is confronted with and precisely positioned relative to the guide groove 174 of the yarn guide 173 as the drawing means.

Fourth Embodiment (FIGS. 17 to 20)

A warp mending device according to a fourth embodiment of the present invention will be described with reference to FIGS. 17 to 20.

The components in the fourth embodiment same as those of the first and third embodiments are denoted at the same numerals and the explanation thereof is omitted.

Figure 17:
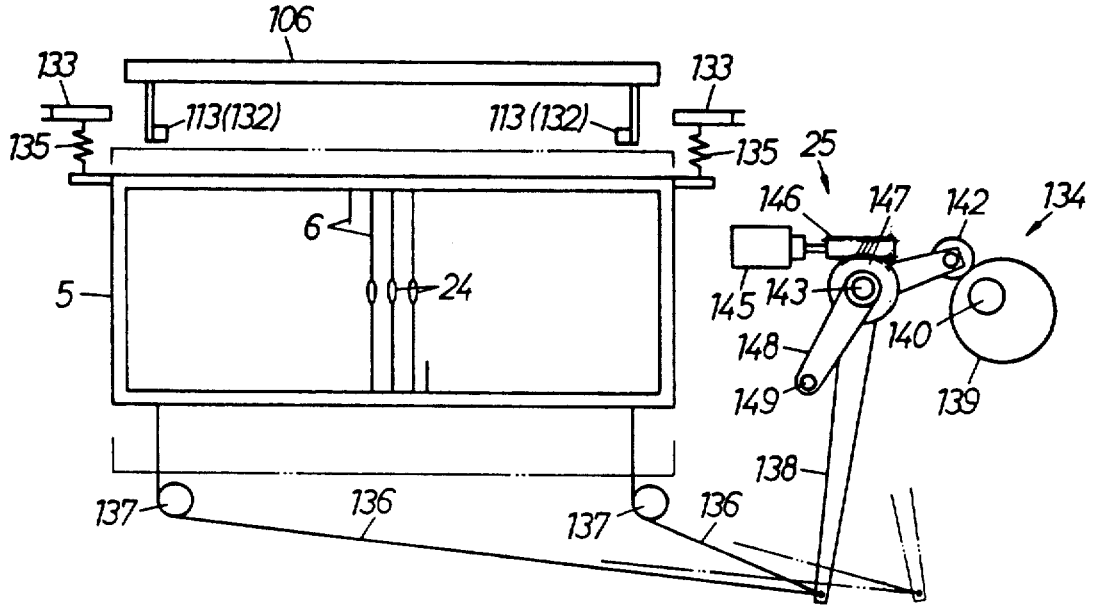
FIG. 17 is a a schematic front view showing a shed driving mechanism and a leveling device of the drawing device serving also as positioning device employed in a warp mending device according to a fourth embodiment of the present invention.

According to the fourth embodiment, the heddle frame 5 alone corresponding to the trailing and leading edges 1*a* and 1*b* is raised by the movement of the cams 139 after other heddle frames other than the heddle frame 5 are lowered, whereby the upper portions of the heddles 6 are confronted with two reference sensors 132 as the reference portion 113 at a predetermined interval, as illustrated in FIG. 17.

All the heddle frames 5 are hung by drawing springs 135, contrary to the third embodiment as illustrated in FIG. 16 and interlocked with the shedding lever 138 by the lower wires 136.

Figure 18:
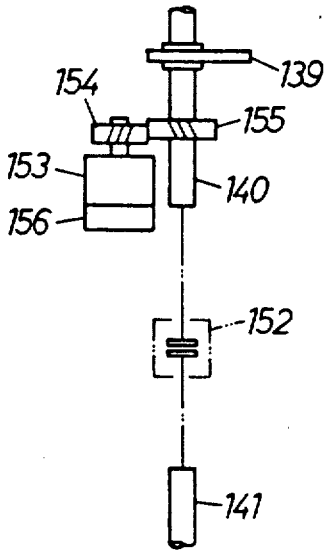
FIG. 18 is a plan view showing a portion interlocked with a shaft of the shedding driving mechanism of FIG. 16.
Figure 19:
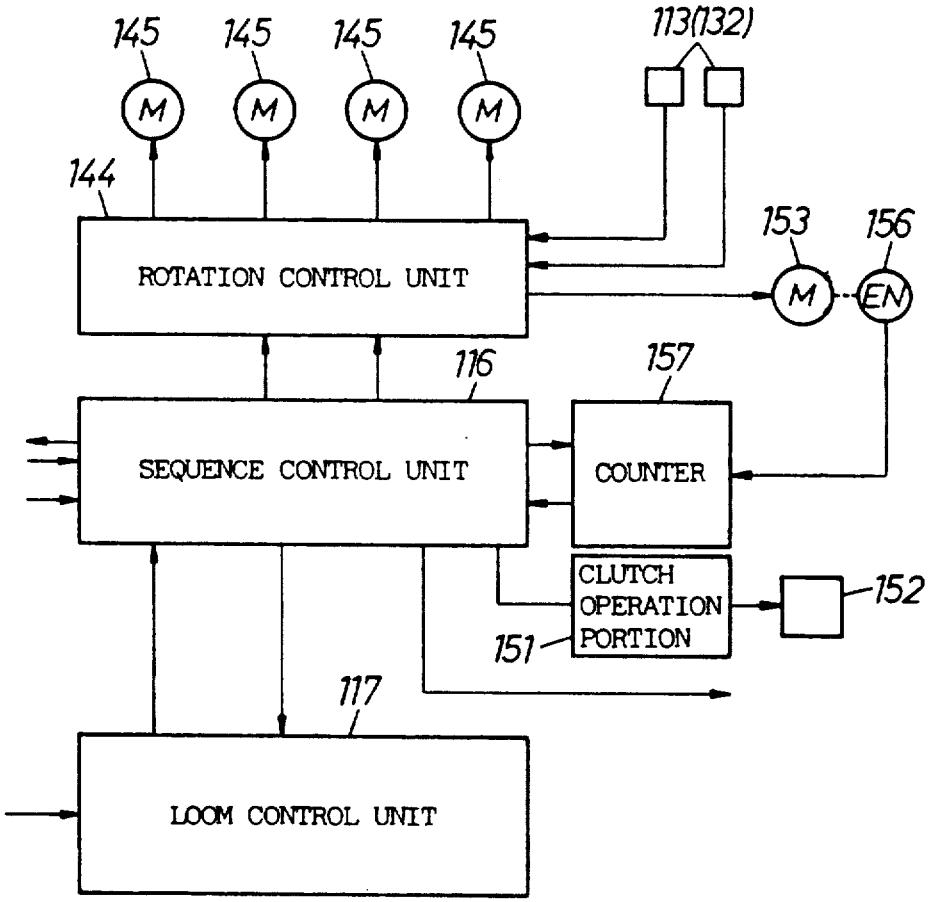
FIG. 19 is a block diagram showing an electrical control portion of the shedding driving mechanism of FIG. 17.

At the time of positioning, the sequence control unit 116 in FIG. 19 supplies data to the rotation control unit 144, thereby driving all the motors 145 for operating all the heddle frames not corresponding to the trailing and leading edges 1*a*, 1*b* (hereinafter referred to other heddle frames) so that the shedding lever 138 alone corresponding to the other frames 5 is rotated counterclockwise to thereby move the cam roller 142 away from the cams 139, and disengage clutches 152 in FIG. 18 by the operation of a clutch operation portion 151. Disengagment of the cluches 152 render the cam shaft 140 separate from the main shaft 141 of the loom, followed by driving a leveling motor 153 to rotate the cam shaft 140 clockwise or counterclockwise by way of gears 154 and 155. Accompanied by the rotation of the cams 139, the No. 2 heddle frame corresponding to the trailing and leading edges 1*a* and 1*b* is driven by the cam 139 and moved vertically and then move upward at the portion where the bottom of the cam 139 corresponds to the cam roller 142 so that the No. 2 heddle frame is projected from other heddle frames 5.

When the upper portion of the heddle frame 5 corresponding to the trailing and leading edges 1*a* and 1*b* approaches the reference sensors 132 such as proximity sensors to the extent for a predetermined interval, the reference sensors 132 detect the approach of the particular heddle frame 5 and supplies a stop signal to the rotation control unit 144 for stopping the rotation of the leveling motor 153. In such a manner, the heddle frame 5 corresponding to the trailing and leading edges 1*a* and 1*b* is positioned with accuracy relative to the reference portion 113 of the drawing device 102. At this time, the rotation of the cam shaft 140, i.e. the leveling motor 153 is detected by a shaft encoder 156 as pulses which are stored in a counter 157.

The counter 157 is reset, at the time of start of the leveling operation. The sequence control unit 116, upon completion of the drawing operation, reads the rotation of the leveling motor 153 from the counter 157 and supplies a reverse rotation command corresponding to the rotation of the leveling motor 153 to the rotation control unit 144 so that the leveling motor 153 is revesely rotated, thereby giving the cam shaft 140 a predetermined rotary phase which is same as the rotary phase before the cam shaft 140 is moved away from the main shaft 141. The sequence control unit 116 drives, after confirmation of these operations, a clutch operation portion 151 so that the clutches 152 are engaged with each other, thereby causing the loom to be ready for restarting.

Figure 20:
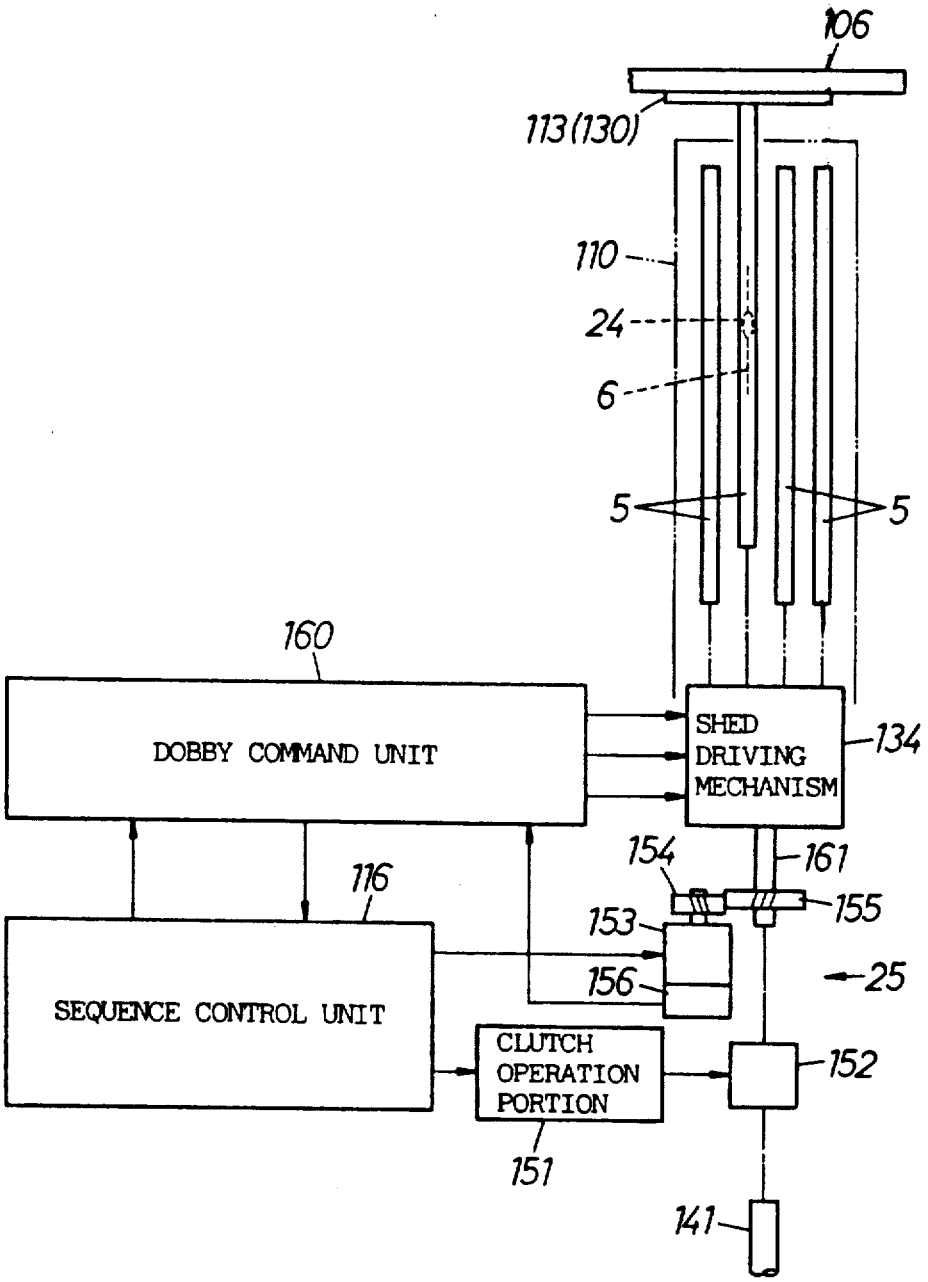
FIG. 20 is a block diagram showing a drawing device employed in a warp mending device according to a fifth embodiment of the present invention.

Fifth Embodiment (FIG. 20)

A warp mending device according to a fifth embodiment of the present invention will be described with reference to FIG. 20.

The components in the fifth embodiment which are the same as those of the first and fourth embodiments are denoted by the same numerals and the explanation thereof is omitted.

The shedding driving mechanism 134 is of a dobby type and driven by a dobby control command unit 160

The sequence control unit 116 drives, at the time of positioning, the clutch 151 so that the clutches 152 are disengaged from each other, then supplies a raising command to the dobby command unit 160 for raising the No. 2 heddle frame 5 alone corresponding to the trailing and leading edges 1*a* and 1*b*, and thereafter drives the leveling motor 153 to thereby rotate the input shaft 161 of the shedding driving mechanism 134 and stops the input shaft 161 at the maximum shedding angle which is detected by the encoder 156. As a result, the No. 2 heddle frame 5 alone is raised. Subsequently, the reference plate 130 is lowered together with the frame and contacts the raised heddle frame 5 so that the mail of the heddle 6 is positioned relative to the drawing device 102.

The sequence control unit 116 supplies, upon completion of the drawing operation, a return command to the dobby command unit 160 so that the leveling motor 153 is reversely rotated to return to the original rotary phase. Then, the sequence control unit 116 supplies the operation permission command to the loom control unit 117 after the clutches 152 are engaged with each other by the clutch operation portion 151.

Figure 21:
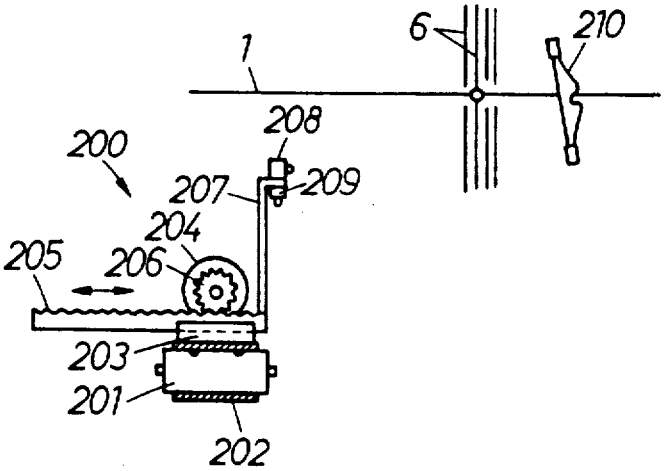
FIGS. 21 to 23 are views showing portions for detecting heddle frame numbers employed in a warp mending device according to another modified example.
Figure 22:
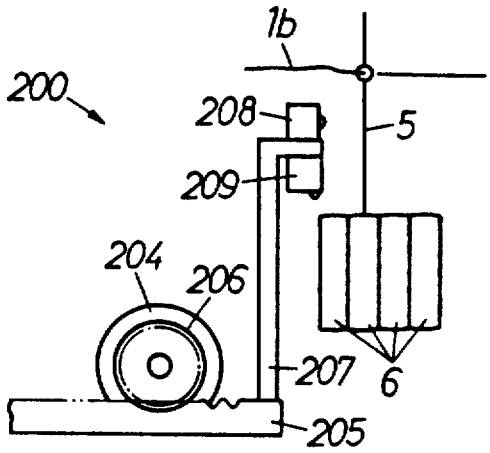
Figure 23:
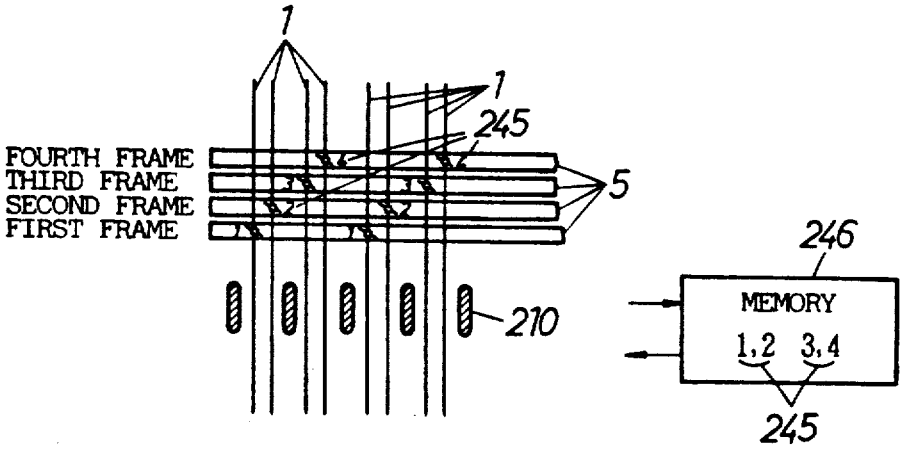

Another Example (FIGS. 21 to 23)

A warp mending device according to another example of the present invention will be described with reference to FIGS. 21 and 23.

The components in this example which are the same as those of the first and fifth embodiments are denoted by the same numerals and the explanation thereof is omitted.

Although the first to fifth embodiments set forth above show preferred embodiments of a combination of the drawing means 107 of the drawing device 102, the detector 103 and the discriminator 104, these components can be replaced by other members without impeding the warp mending operation. The drawing means 107 is not limited to those as set forth the above embodiments but can be replaced by the known member.

The discriminator 104 set forth in the above embodiments reads the identification code of the dropped drop wires 4 and judges the number of the heddle frame 5 corresponding to the trailing and leading edges 1*a* and 1*b*. The detection of the number of the heddle frame 5 can be made by a detector 200. The detector 200 is supported, as illustrated in FIGS. 21 and 22, by an endless belt 202 which is entrained around a pair of pulleys 201 which are drived by a driving motor, not shown, and slidably holds a rack 205 by a guide 203 which is movable in the direction of the warps 1. The rack 205 is movable by a pinion 206 of a motor 204 in the direction of the warps 1 and has a holder 207 at the tip end thereof which holder 207 is provided with sensors 208 and 209 at the tip end thereof in which the sensor 208 is directed laterally and the sensor 209 is directed downward.

The laterally directed sensor 208 detects the heddle 6 supported by the heddle frame 5 while the downward directed sensor 209 specifies one of the plural heddles 5. In the modified example, four heddle frames 5 are, as illustrated in FIG. 23, arranged in the direction of the warps 1. Each of the heddle frames 5 supports the four warps 1 successively aslant which are repeated to support all the warps 1. These warps 1 are respectively supported by the heddles 6 while two warps 1 are drawn into one reed 210. Accordingly, there is established a predetermined relationship between two warps 1 drawn into one reed 210 and the numbers of heddles supporting the warps 1.

Identification codes 245 are affixed to each of the heddles 5 supporting the heddles 6 into which the warps 1 are drawn. The identification codes 245 are respectively stored in a memory 246 for each reed into which the warp 1 is drawn.

At the time of detection of the number of the heddle frame, the detector 200 advances toward the leading edge 1*b* and stops after movement in a predetermined amount of movement. Next, the motor 204 is turned on and rotated in the normal direction so that both the sensors 208 and 209 advance toward the heddles 6. During the advancement, if the sensor 209 is ON, it revealed that the detector 200 reaches the first heddle frame 5 whereby the rotation of the motor 204 is detected so that the counting is caried out by, e.g. an exclusive controller. Thereafter, if the sensor 208 is ON, the heddle 6 is detected, whereby the counting operation is stopped so that the frame number of the heddle 5 is calculated on the basis of the counted rotation of the motor.

The calculation of the frame number is effected, e.g. by calculating the mulitiple by which the counted rotation of the motor and the number or rotations stored in the memory is multiplied. Consequently, there is detected the identification code 245 of the heddle 6 in which the trailing and leading edges 1*a* and 1*b* are drawn. Then, the controller sets the positional condition after judging which side, i.e. left or right the warp 1, which is drawn in the reed 210 in which the trailing and leading edges 1*a* and 1*b* is drawn, is located on the basis of the content of the memory 245 and the calculated identification code 245. Thereafter, the motor 204 is turned on in the reverse direction to move the motors 208 and 209 backward while the detector 200 alone is displaced in the width direction of the loom by driving a motor, not shown, if need b.

There is a method for detecting the number of the heddle frame 5 by detecting the number of the heddle frame 5 supporting the dropped heddle 6 which is an application of the known warp stop motion which detects the breakage of the broken warp 1 by detecting the drop of the heddle 6.

What is claimed is:

1. A warp mending device comprising:

a yarn guide having a yarn guide line extending in the entire longitudinal direction thereof, the yarn guide movable positioned between a drop wire and a heddle corresponding to a trailing edge and a leading edge of a broken warp so that a mending yarn is drawn into a slot of the drop wire and a mail of the heddle;

a nozzle for generating air current in the drawing direction within the yarn guide line;

a yarn leading device for drawing the mending yarn unwound from a bobbin into the slot of the drop wire or the mail of the heddle whichever is located upstream of a drawing direction and leading the thus drawn mending yarn into an inlet of the yarn guide line; and a positioning device for positioning the slot of the drop wire or the mail of the heddle, whichever is located downstream of the drawing direction, relative to an outlet of the yarn guide line so as to confront said outlet.

2. A warp mending device according to claim 1, wherein the yarn guide comprises a drawing nozzle which also serves as the nozzle.

3. A warp mending device according to claim 1, wherein the nozzle comprises a plurality of guide nozzles provided along the yarn guide line.

4. A warp mending device comprising:

a drawing device composed of drawing means for drawing a trailing edge and leading edge of a broken warp into a corresponding heddle and a reference portion fixed to the drawing means at a predetermined positional relationship with the drawing means; the drawing device further comprises:

a detector for detecting positions of the trailing edge and the leading edge of a broken warp in a width direction of a loom;

a discriminator for discriminating a heddle frame corresponding to the trailing edge and the leading edge;

a leading guide for receiving data of the broken warp in the width direction of the loom from the detector and moving a drawing yarn from a standby position along the width direction of the loom while receiving data of the heddle frame from the discriminator and displacing the drawing device in the direction of the warps to move it to the position of the heddle frame corresponding to the trailing and leading edges of the broken warp, and thereafter moving the drawing device vertically so that the reference portion of the drawing device establishes a predetermined positional relationship with the heddle frame corresponding to the trailing and leading edges of the broken warp.

5. A warp mending device comprising:

a drawing device composed of drawing means for drawing a trailing edge and leading edge of a broken warp into a corresponding heddle and a reference portion fixed to the drawing means at a predetermined positional relationship with the drawing means; the drawing device further comprises:

a detector for detecting positions of a trailing edge and a leading edge of a broken warp in a width direction of a loom;

a discriminator for discriminating a heddle frame corresponding to the trailing edge and the leading edge;

a leveling device for receiving data of the heddle frame from the discriminator for displacing the heddle frame corresponding to the trailing and leading edges of the broken warp toward the reference portion and for receiving data of the broken warp in the width direction of the loom from the detector and for moving the drawing device from a standby position along the width direction of the loom, and or also moving the drawing device vertically so that the reference portion of the drawing device is in a predetermined positional relationship with the heddle frame corresponding to the trailing and leading edges of the broken warp.

* * * * *